United States Patent [19]

Dougherty

[11] 4,337,714

[45] Jul. 6, 1982

[54] SAILBOAT MAST DISPLACEMENT SYSTEM

[76] Inventor: Frank I. Dougherty, 2020 Shadowood Ct., Columbia, S.C. 29210

[21] Appl. No.: 166,148

[22] Filed: Jul. 7, 1980

[51] Int. Cl.[3] ..... B63H 9/04

[52] U.S. Cl. ..... 114/90

[58] Field of Search ..... 114/90, 91

[56] References Cited

U.S. PATENT DOCUMENTS

| | | | |
|---|---|---|---|
| 641,321 | 1/1900 | Perkins | 114/91 |
| 1,916,459 | 7/1933 | Blackman | 114/91 |
| 4,005,669 | 2/1977 | Klemm | 114/91 |

*Primary Examiner*—Sherman D. Basinger

*Attorney, Agent, or Firm*—George M. Thomas

[57] ABSTRACT

The mast displacement system is mounted on the hull of a sailboat and holds the mast in a movable, upstanding relationship on the hull. A rectilinear mast guide track is rigidly mounted to the hull of a sailboat and extends in an approximately horizontal attitude and transverse to the longitudinal centerline of the hull, and a mast pedestal includes track engaging guides which engage the mast guide track so that the pedestal is movable along the length of the mast guide track. The mast of the sailboat is held by the mast pedestal in an upstanding attitude, and a plurality of mast stabilizer arms extend laterally from the mast pedestal and move in unison with the mast pedestal, with the forwardly extending one of the stabilizer arms being slidably connected to a second rectilinear guide track mounted to the hull of the boat. Mast support stays extend between the upper portion of the mast and the outer end portions of each of the mast stabilizer arms, and a mechanical operator moves the mast pedestal, mast and mast support stays in unison across the length of the hull.

3 Claims, 4 Drawing Figures

SAILBOAT MAST DISPLACEMENT SYSTEM

BACKGROUND OF THE INVENTION

This invention relates to a system for moving the mast of a sailboat from one side to the other side of the hull of the boat while the boat is underway, substantially without changing the attitude of the mast with respect to the boat.

The speed of a sailboat through the water is dependent upon several factors besides the main factor of the force and the direction of the wind in relation to the heading of the boat. For example, the sail area, the waterline length of the hull, the wet surface of the hull, the underwater hull shape, and the stiffness of the boat in the water are all factors involved that relate to sailboat speed, and thus are factors to be considered in the design of a sailboat.

Stiffness, or the resistance of a sailboat to the forces causing it to heel or tip sideways in the water, is one of the main factors in determining the speed of a sailboat. All other factors being equal, a sailboat which is more resistant to heeling over in the water can catch more wind with its sail or can carry more sail in a given wind.

Stiffness in a sailboat usually is controlled by a combination of several design factors. One of these is the ballast or weight placed as low in the hull of the sailboat as possible or under the bottom of the boat. Increasing the ballast of a small light displacement boat usually lowers the center of gravity of the hull and results in increasing the stiffness of the boat. When the wind tilts or heels the boat by creating a sideways force on the sails, the hull of the boat tends to rotate or tilt in the water about its center of gravity. Therefore, increasing the ballast tends to increase the poise of the boat, to resist the rotation of the boat in the water.

Another way of increasing sailboat stiffness is to use a centerboard or keel. The centerboard or keel usually is placed under the centerline of the boat, parallel to the length of the boat, so that, for example, if the mast of the boat is tilted to the right, the centerboard or keel must move to the left. Again, when the boat heels, the centerboard, which is located well below the center of gravity of the boat, resists this rotation by pushing against the water beneath the boat, thus resisting tilting of the boat.

Another way to increase stiffness of a sailboat is to increase the width of the hull since a wider boat provides a broader base for supporting the boat in the water.

When the design of a sailboat is modified so as to increase the stiffness of the boat, as by increasing the hull width, or by increasing the size of a centerboard, or by increasing the ballast, these changes tend to reduce the speed of the boat even though the resulting increased stiffness tends to increase the speed of the boat by holding the mast and sails in a more upright attitude to catch more wind.

SUMMARY OF THE INVENTION

Briefly described, the present invention comprises a mast displacement system for sailboats wherein the upstanding mast as well as its stays are movable in unison across the length of the boat, from one side to the other side of the boat, so that the weight of the mast and sails can be moved to the windward side of the boat, thus moving the weight of the mast and sails to the side of the boat that is normally tilted up by the force of the wind, and tending to right the boat, and placing the sails closer to the oncoming wind so that the hull does not block as much wind from the sails. Increasing the distance of the mast from the leeward side of the boat moves the center of effort to windward of the center of gravity of the boat.

A rectilinear mast guide track is rigidly mounted to the hull of the boat and extends transversely with respect to the longitudinal centerline of the boat, and a mast pedestal includes track engaging guides movably mounted to the mast guide track and the mast is supported by the mast pedestal so that the mast pedestal and the mast of the boat can move in a rectilinear path across the length of the hull of the boat. The mast pedestal includes a plurality of mast stabilizer arms which radiate outwardly from its central portion and stays are connected at their upper ends to the upper portion of the mast and at their lower ends to the distal end portions of the stabilizer arms. One of the mast stabilizer arms extends in a forward direction from the mast while the other stabilizer arms extend at angles rearwardly from the mast. A second rectilinear guide track is mounted to the hull of the boat and extends parallel to the mast guide track. The forwardly extending mast stabilizer arm is slidably connected to the second rectilinear guide track and is movable along the length of the guide track in unison with the mast pedestal and mast as they move along the mast guide track. A winch and cable assembly function as an operator to move the mast and mast pedestal with its stabilizer arms along the rectilinear mast guide track.

Thus, it is an object of this invention to provide a mast displacement system for sailboats wherein the mast and its stays can be moved in unison from one side to the other side of the hull of the boat, while maintaining the mast and the hull of the boat in a substantially constant angular attitude with respect to each other.

Another object of this invention is to provide a mast displacement mechanism for a sailboat wherein the upstanding mast can be shifted laterally with respect to the longitudinal center line of the boat while the boat is underway.

Another object of this invention is to provide a means for increasing the stiffness of a sailboat substantially without increasing the weight of the boat or the resistance of the boat movement through the water.

Other objects, features and advantages of this invention will become apparent upon reading the following specification, when taken in conjunction with the accompanying drawings.

DETAILED DESCRIPTION

Figure 1:
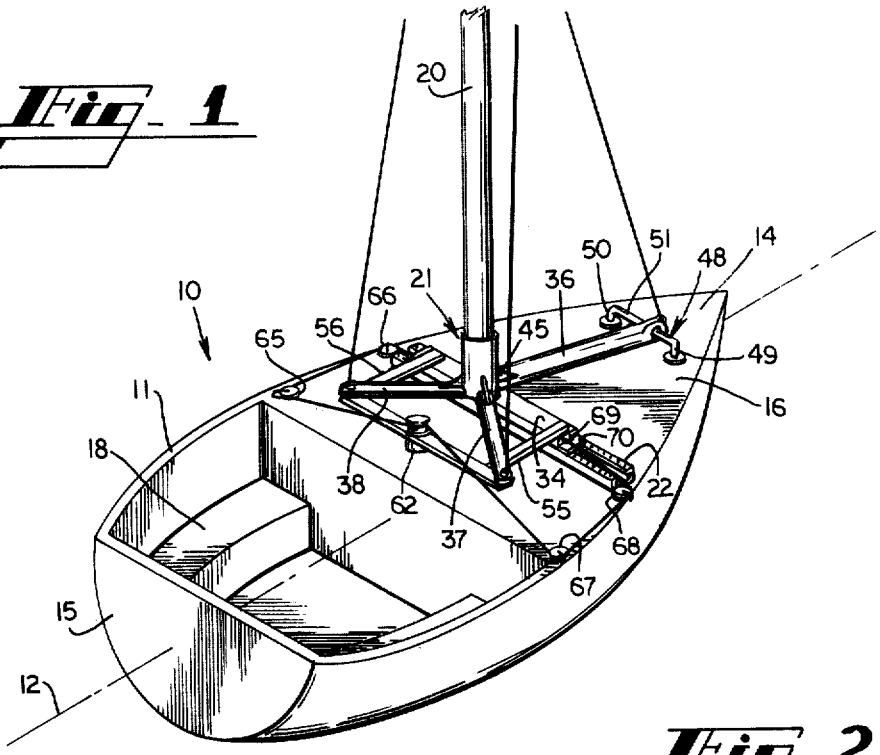
FIG. 1 is a perspective illustration of a mast displacement system as applied to a monohull sailboat.
Figure 2:
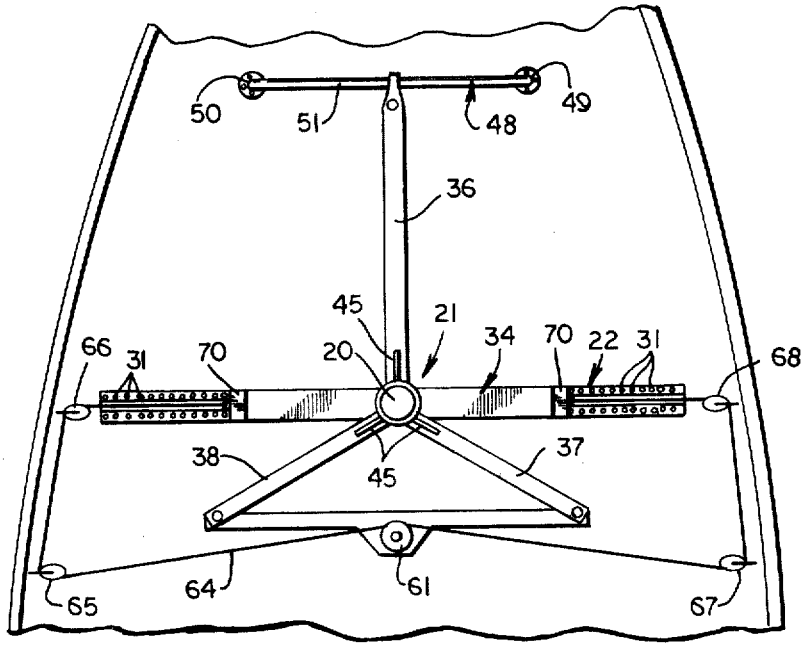
FIG. 2 is a plan view of the mast displacement system.
Figure 3:
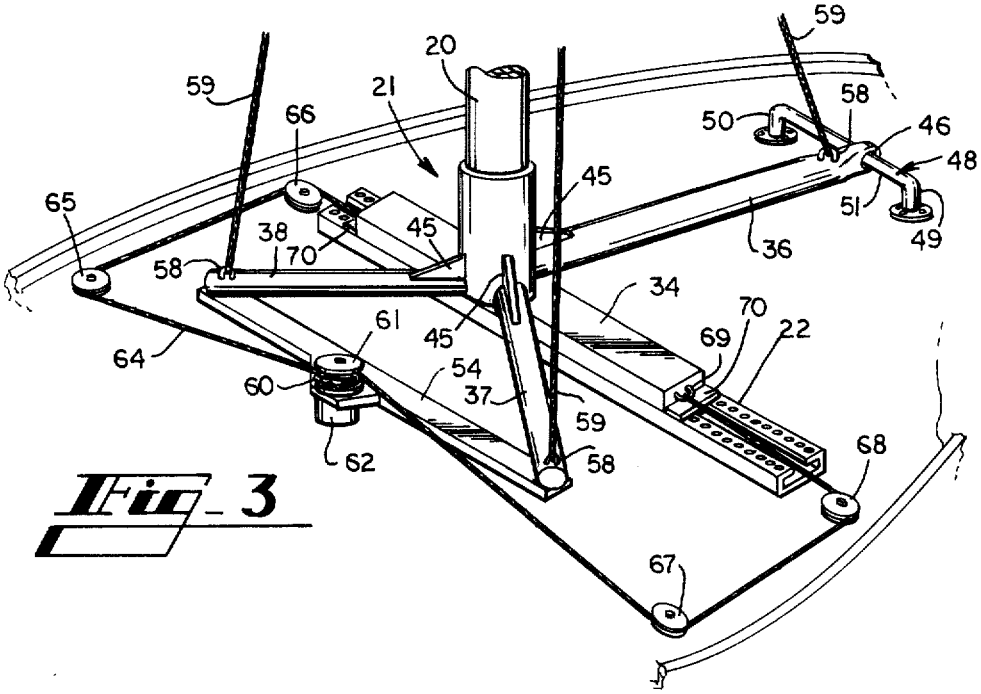
FIG. 3 is a perspective illustration of the mast displacement system.

Referring now in more detail to the drawing, in which like numerals indicate like parts throughout the several views, FIG. 1 illustrates a sailboat 10 that includes a hull 11 having a longitudinal centerline or rolling axis approximately at 12 extending horizontally from the bow or stem 14 to the transom 15 and through the center of gravity of the boat. In the embodiment illustrated, the hull 11 has its forward portion covered with decking 16, while the aft portion of the hull is open at 18 to accomodate passengers, etc.

Mast 20 is oriented in an upstanding, substantially upright attitude with respect to hull 11. Mast pedestal 21 is movably mounted on hull 11 and supports mast 20. Mast guide track 22 is rigidly mounted to hull 11 and extends transversely with respect to the centerline 12 of the hull, from one side to the other side of the boat.

Figure 4:
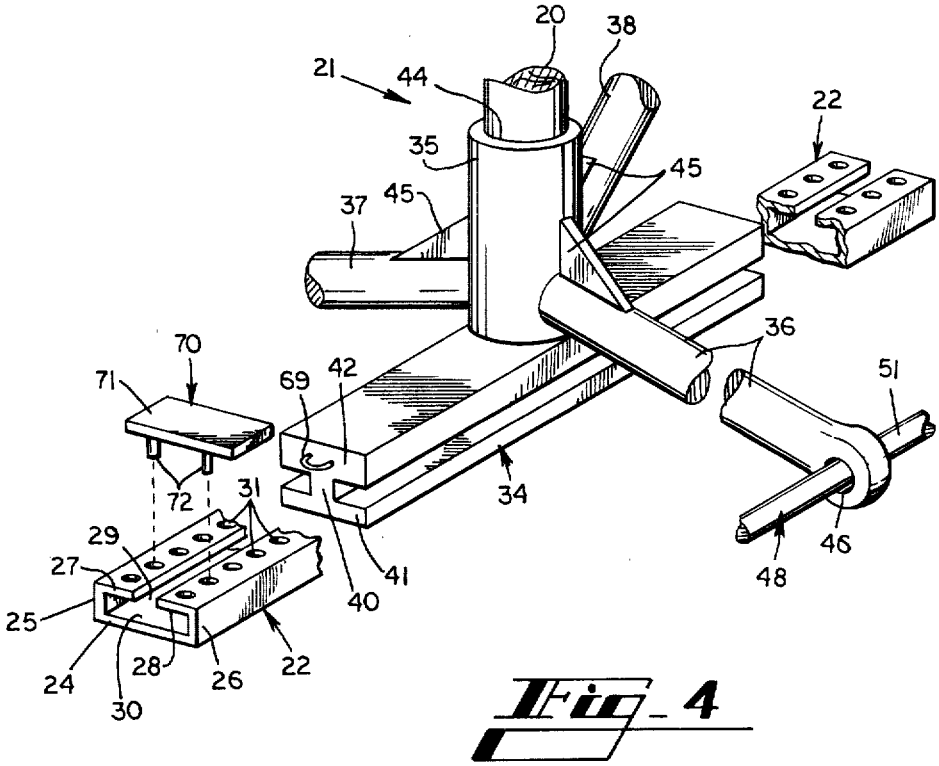
FIG. 4 is a perspective illustration with parts broken away of the mast guide track and a lock clip for locking the mast pedestal in place on the mast guide track.

As illustrated in FIG. 4, mast guide track 22 is an approximately boxed-shaped rectilinear beam including bottom wall 24, side walls 25 and 26 and inwardly turned flanges 27 and 28 that form upwardly facing elongated slot 29. The beam defines elongated rectilinear opening 30 extending therethrough. A plurality of lock pin openings 31 are formed through the inwardly turned flanges 27 and 28. The mast guide track 22 is rigidly fastened to the decking 16 and to the struts supporting the decking (not shown) by means of bolts or other fasteners extending through bottom wall 24 of the mast guide track and through the decking and struts.

Mast pedestal 21 comprises track engaging guide 34, mast socket 35 and stabilizer arms 36, 37 and 38. Guide 34 is a rectilinear, H-shaped beam having central web 40 and lower and upper flanges 41 and 42. The width and height of web 40 corresponds to the width and height of the slot 29 formed between the inwardly turned flanges 27 and 28 of the mast guide track 22, while the lower flange 41 corresponds in size and shape to the size and shape of opening 30 of the mast guide track 22. The upper flange 42 of the guide 44 extends over the inwardly turned flanges 27 and 28. Thus, guide 34 is movable in a telescoping relationship with respect to mast guide track 22, in a direction extending across the hull of the boat. Mast socket 35 is rigidly mounted to the upper flange 42 of mast guide 34, intermediate ends of the mast guide. The upwardly facing opening 44 of mast socket 35 is sized and shaped to correspond to the external dimensions of the lower end of the mast 20, so that the mast can be received in the socket. Fasteners such as bolts or set screws (not shown) can extend through mast socket 35 and into engagement with mast 20 to rigidly mount the mast in its socket 35, if desired. Support webs 45 are rigidly connected between mast socket 35 and stabilizer arms 36, 37 and 38, so that the stabilizer arms are rigidly mounted to the mast socket and to the mast guide 34. As an alternate embodiment of the invention the lower end portion of the mast can be directly mounted to mast guide 34 (not shown).

Stabilizer arm 36 extends in a forward direction from mast socket 35, and the forward distal end of the stabilizer arm 36 is formed with a laterally extending opening 46 therethrough. A second rectilinear guide track 48 is rigidly mounted to the hull 11 of the sailboat 10. In the embodiment illustrated, guide track 22 is an inverted U-shape, with its downwardly extending leg elements 49 and 50 mounted to the decking 16 of the boat and with its intermediate leg 51 functioning as the rectilinear guide track. The intermediate leg or guide track 51 is oriented parallel to mast guide track 22, and extends transversely with respect to the longitudinal center line 12 of the hull 11 of the sailboat. The opening 46 of the forward stabilizer arm 36 extends about the intermediate leg 51 of the second rectilinear guide track 48, and is movable therealong with the movement of the mast pedestal 21 and mast 20, in a manner described in more detail hereinafter.

Stabilizer arms 37 and 38 extend at angles rearwardly from mast socket 35, and transverse brace 54 is connected at its ends to the ends of stabilizer arms 37 and 38. Optionally, additional longitudinal braces 55 and 56 (FIG. 1) are connected at their ends to the ends of transverse brace 54 and to mast guide 34. Each of the stabilizer arms 36, 37 and 38 include connector hooks 58 or similar connector means adjacent their end portions, and mast stays or cables 59 are extended from the upper portion of the mast 20 to each of the connectors 58. Since the stabilizer arms 36, 37 and 38 have their connectors 58 located in a triangular relationship at the base of mast 20, the stays 59 function to hold the mast in an upright attitude.

Winch 60 is mounted on transverse brace 54 of mast pedestal 21, and winch motor 62 is in driving relationship with respect to winch 60. Flexible cable 64 extends from the reel 61 of the winch about guide pulleys 65 and 66 at one side of the hull and about guide pulleys 67 and 68 on the other side of the hull, and are connected to the ends of mast guide 34 by connecting the free ends of the cable to hooks 69. When the winch is operated by its motor 62, reel 61 pays out the cable in one direction and reels in the cable from the other direction. This causes mast guide 34 to move in its mast guide track 22 across the length of the hull of the boat, causing the entire mast pedestal 21 and mast 20 to move across the boat. In the meantime, the forward stabilizer arm 36 of the mast pedestal moves in unison with the mast, with its opening 46 moving about the forward or second rectilinear guide track 48. If desired, which 60 can be mounted to the hull 11 instead of to the transverse brace 54.

When the mast 20 has been moved to the desired location, locking cleats 70 are placed in the lock pin openings 31 of the mast guide track 48 at both ends of the mast guide 34 to keep the mast from moving along the mast guide track 22. Each locking cleat 70 includes a plate 71 with locking pins 72 extending downwardly therefrom, and the pins are spaced apart a distance corresponding to the spacing of the lock pin 31 openings of mast guide track 22. When the pins 72 are inserted into the lock pin openings 31, the plate 71 obstructs further movement of the mast guide 34, and inadvertent movement of the mast with respect to the sailboat is avoided.

While the disclosed embodiment of the invention illustrates a monohull sailboat of a particular configuration, it will be understood by those skilled in the art that various other sailboat configurations can be equipped with the sailboat mast displacement system. For example, a catamaran hull and other hull configurations can accomodate the disclosed mast displacement system. In addition, while a particular mast guide track 22 and mast pedestal 21 combination has been disclosed, it will be understood that other guide track and pedestal configurations can be utilized without departing from the scope and concept of the disclosed invention. Therefore, while this invention has been described in detail with particular referrence to a preferred embodiment thereof, it will be understood that variations and modifications can be effected within the spirit and scope of the invention as described hereinbefore and as defined in the appended claims.

I claim:

1. A mast displacement mechanism for a sailboat or the like including a hull with a longitudinal centerline and an upstanding mast with its lower end mounted to the hull, said mechanism comprising:

a rectilinear mast guide track for rigidly mounting to the hull and extending in an approximately horizontal attitude transversly to the longitudinal centerline of the hull, a mast pedestal for holding the mast in an upstanding attitude, said mast pedestal including track engaging guide means mounted to said mast guide track and movable along the length of said mast guide track across the hull of the boat for moving the mast from one side to the other side of the boat substantially without changing the attitude of the mast with the hull of the boat, said mast pedestal further including stabilizer arms extending therefrom in different directions and movable in unison with said mast pedestal along the length of said mast guide track, mast stays for connection between said stabilizer arms and the upper portion of said mast for holding said mast in an upright attitude and for movement in unison with said mast pedestal and said stabilizer arms, operator means operatively connected to said mast pedestal for moving said mast pedestal along the length of said mast guide track, lock means for holding said mast pedestal in a fixed position on said mast guide track, a second rectilinear guide track for rigidly mounting to the hull and extending parallel to said mast guide track, one of said stabilizer arms extending approximately parallel to the longitudinal centerline of the hull of the boat and mounted at its end on and movable along said second rectilinear guide track, and the others of said stabilizer arms extending from said mast pedestal to opposite sides of the centerline of the boat.

2. A mast displacement mechanism for a sailboat or the like including a hull with a longitudinal centerline and an upstanding mast with the lower end thereof supported by the hull, said mast displacement mechanism comprising:

a first rectilinear mast guide track for rigid mounting to the hull of the boat and extending in an approximately horizontal attitude transversly to the longitudinal centerline of the hull of the boat, a second rectilinear guide track for rigid mounting to the hull of the boat parallel to said first guide track, a mast pedestal for holding the mast in an upstanding attitude, said mast pedestal including track engaging guide means mounted to said first mast guide track and movable along the length of said first mast guide track for guiding the mast across the length of the hull of the boat substantially without changing the attitude of the mast with the hull of the boat, said mast pedestal including a plurality of mast stabilizer arms extending therefrom at least two of which extend in different directions on opposite sides of the centerline of the boat and all of which are movable in unison with said mast pedestal, said mast stabilizer arms each including connector means displaced from said mast pedestal for fastening mast support stays thereto, one of said mast stabilizer arms movably connected to said second rectilinear guide track and movable along the length of said second guide track for stabilizing the mast, operator means operatively connected to said mast pedestal for moving said pedestal along the length of said mast guide track, and lock means for engaging said mast guide track and holding said pedestal in a fixed position on said mast guide track, whereby the mast and mast pedestal are movable in a rectilinear path across the length of the hull of the boat and the mast is supported by the mast support stays extending between the upper portion of the mast to the mast stabilizer arms.

3. The mast displacement system of claim 2 and wherein said operator means comprises a winch and cable means for connection between said winch, the hull of the boat and said pedestal in an arrangement whereby rotation of the winch in one direction of rotation moves the pedestal and the mast in one direction across the length of the hull of the boat and rotation of the winch in the other direction of rotation moves the pedestal and the mast in the other direction across the length of the boat.

* * * * *